US009206642B2

(12) United States Patent
Harucksteiner et al.

(10) Patent No.: US 9,206,642 B2
(45) Date of Patent: Dec. 8, 2015

(54) TURNSTILE ACCESS-CONTROL DEVICE

(71) Applicant: SkiData AG, Grodig/Salzburg (AT)

(72) Inventors: Guido Harucksteiner, Eugendorf (AT); Markus Leitner, Rohrdorf (DE); Reinhard Surkau, Traunstein (DE)

(73) Assignee: SKIDATA AG, Groedig/Salzburg (AT)

( * ) Notice: Subject to any disclaimer, the term of this patent is extended or adjusted under 35 U.S.C. 154(b) by 275 days.

(21) Appl. No.: 13/799,320

(22) Filed: Mar. 13, 2013

(65) Prior Publication Data

US 2014/0096447 A1 Apr. 10, 2014

(30) Foreign Application Priority Data

Oct. 4, 2012 (EP) ..... 12187146

(51) Int. Cl.

| | |
|---|---|
| ***G07C 9/02*** | (2006.01) |
| ***E06B 11/08*** | (2006.01) |
| ***E05F 15/20*** | (2006.01) |
| ***E05F 15/73*** | (2015.01) |

(52) U.S. Cl.

CPC ..... *E06B 11/08* (2013.01); *E05F 15/2023* (2013.01); *E05F 15/73* (2013.01); *G07C 9/02* (2013.01)

(58) Field of Classification Search

USPC ..... 49/42, 44, 45, 46, 47; 235/93; 109/8
IPC . E06B 11/08; E05F 15/03,15/2023; G07C 9/02
See application file for complete search history.

(56) References Cited

U.S. PATENT DOCUMENTS

| | | | | | |
|---|---|---|---|---|---|
| RE18,211 | E | * | 9/1931 | Tulchin | 49/47 |
| 2,144,718 | A | * | 1/1939 | Gersbach | 49/47 |
| 4,358,909 | A | * | 11/1982 | Trikilis | 49/42 |
| 5,390,444 | A | * | 2/1995 | Simonin et al. | 49/47 |
| 6,044,586 | A | * | 4/2000 | Wotke | 49/47 |
| 6,715,234 | B1 | * | 4/2004 | Libardi | 49/42 |
| 6,929,175 | B2 | * | 8/2005 | Stockhammer et al. | 235/379 |
| 2009/0307976 | A1 | * | 12/2009 | Burgin | G07C 9/02 49/47 |
| 2009/0312873 | A1 | * | 12/2009 | Gallenschutz | 700/275 |

FOREIGN PATENT DOCUMENTS

| | | | |
|---|---|---|---|
| EP | 1023698 | B1 | 6/1999 |
| EP | 1720134 | A2 | 3/2006 |
| GB | 205 724 | * | 10/1923 |
| GB | 2 119 429 | * | 11/1983 |
| WO | 0227669 | A1 | 4/2002 |

* cited by examiner

*Primary Examiner* — Gregory Strimbu
(74) *Attorney, Agent, or Firm* — Karl F. Milde, Jr.; Eckert Seamans Cherin & Mellott, LLC

(57) ABSTRACT

A turnstile personnel access-control device (1) has one or more blocking arms (2, 3) connected to a drive element (5) mounted on a carrier (4) such that the blocking arms are rotatable about a main axis or shaft (11). The blocking arms (2, 3) assume a blocking position and at least one free position in dependence upon the rotation of the drive element (5). Each blocking arm (2, 3) includes a flat component (6, 7) that is mounted to rotate about a longitudinal axis (8, 9) thereof in dependence upon the rotation of the drive element (5). In the blocking position of the blocking arms (2, 3), one such flat component assumes a pre-defined angular position with respect to the vertical, whereas in the free position, this flat component (6, 7) is rotated such that passage of a person is allowed.

7 Claims, 6 Drawing Sheets

TURNSTILE ACCESS-CONTROL DEVICE

BACKGROUND OF THE INVENTION

The invention relates to a personnel access-control device in the form of a turnstile for controlling access to a defined area.

Personnel access-control devices are well known in the prior art. For example, a device is known from EP 1 023 698 B1 in which an antenna unit for communication with an RFID (radio-frequency identification device) transponder acts as data medium in which access authorization is stored. Personnel access-control devices further include a blocking device actuated via a control circuit by an actuator in order to allow a person to enter or exit a building or controlled space. For this, the blocking device is released from a blocking position into a free position upon readout of a valid access authorization. In the free position, access is provided to a person, and/or the width of a passage is not restricted. In contrast, access is denied in the blocking position. In such access-control devices, a turnstile is often used as the blocking device.

Turnstiles as known in the art include a main shaft directed downward that is mounted on a carrier, and to which, for example, three blocking arms are affixed. Alternatively, the main shaft may include one or two blocking arms. The pivot axis of the main shaft is advantageously inclined at 30° to 60° to the horizontal, particularly at 45°, whereby the angle of the blocking arms to the pivot axis is 30° to 60°, and advantageously 45°. In a projection to the plane perpendicular to the pivot axis, the angle between the blocking arms for three blocking arms is 120°, and 180° for two blocking arms. Tilting of the pivot axis reduces the direct angle between blocking arms (~83° with 3 blocking arms, ~80° with 2 blocking arms).

Furthermore, the carrier to which the main shaft is mounted may be implemented as a post to which is secured a reader device that, upon read-out of a valid access authorization, triggers an actuator to rotate the main shaft and thus to provide access.

In the case of access-control devices for personnel that read access authorizations from RFID transponders without contact, the reader device includes a housing with an antenna unit oriented along the passage direction and advantageously extending from above to below in order to be able to read the RFID transponder. For this, a suitable electronic circuit to control the antenna unit may also be mounted within this housing.

The laterally-positioned RFID antenna units known in the art are disadvantageously expensive and require substantial installation space. Furthermore, concentrating the electromagnetic or magnetic field based on the volume of passing persons, and thus reducing signal cross-talk to and from adjacent access points, is linked to considerable expense. Screening measures required to accomplish this cause a significant redaction in the identification range, and must be carefully compensated using suitable electronic means.

Disadvantageously, using known personnel control devices that use laterally-mounted RFID antenna units may detect persons in adjacent access points, or may detect several persons standing in line from electromagnetic or magnetic fields of the antenna units, which detracts from the function of access-control devices and from user convenience.

SUMMARY OF THE INVENTION

A principal object of the present invention is to provide a personnel access-control device, implemented as a turnstile, in which the above-mentioned disadvantages of access-control devices known in the art are avoided. The turnstile must include blocking arms with large surface areas without limiting the passage width. Furthermore, the use of laterally-mounted RFID antenna units is to be avoided, allowing the electromagnetic or magnetic fields to be concentrated in the region of the persons that pass through.

Furthermore, the personnel access-control device based on the invention must enable additional functions such as, for example, a high-visibility advertising surface or integrated illumination.

These objectives, as well as further objectives which will became apparent from the discussion that follows, are achieved, in accordance with the present invention, by providing a personnel access-control device, implemented as a turnstile, that includes one, two, or three blocking arms connected to a main shaft mounted on a carrier, whereby the blocking arms assume a blocking position and at least one free position in dependence upon the rotation of the main shaft.

Based on the invention, each of the blocking arms possesses a flat component part that is mounted to rotate about the longitudinal axis of the arm. Rotation of the flat component occurs about this longitudinal axis in dependence upon the rotation of the main shaft in such a manner that, in the blocking position of the blocking arm, a pre-defined angular position of the flat component with respect to the perpendicular direction is achieved, and the flat component is rotated to at least one free position such that passage of a person is allowed and/or that the passage width is not limited.

The flat components of the blocking arms may be paddle-shaped, rectangular, elliptical, or otherwise configured, perhaps in accordance with an associated activity such as a snowboard.

The rotary motion of the flat components about the longitudinal axis of the blocking arms based on the invention may be controlled electro-mechanically, mechanically via connecting-link guides, or via a transmission functionally connected with the main shaft. When the angular velocity of the rotary motion of the flat components about the longitudinal axis of the blocking arms is advantageously half the angular velocity of the rotary motion of the main shaft, then the rotary motion of the flat components about the longitudinal axis of the blocking arms with respect to the rotary motion of the main shaft occurs within the first half-rotation of the main shaft in the same or opposite rotational direction of the main shaft, while during the second half-rotation of the main shaft, the rotary motion of the flat components occurs in the opposite or same rotational direction of the main shaft, which ensures that, upon one full rotation of the main shaft, each of the flat components comes to rest in the blocking position along only one rotational direction.

This proves to be particularly advantageous if an RFID antenna unit is incorporated into the flat components of the blocking arms that emits only in the direction perpendicular to the surface of the flat components, since on the one hand, the electromagnetic field of the antenna unit in the blocking position of the blocking arms is always oriented toward the area in which a person for read-out of access authorization is located, and on the other hand, read-out of access authorization of persons who have already passed through is prevented.

One or both sides of the flat components of the blocking arms may be implemented as conventional advertising space including a display. Since the flat components of the blocking arms come to rest in the blocking position along only one rotational orientation, only one display and/or advertising surface needs be provided.

The flat components of the blocking arms may advantageously be dimensioned such that at least one RFID antenna unit, that communicates with RFID transponders implemented as a data medium to read access authorization may be integrated into them, as explained above. According to the invention, the flat components of the blocking arms may be implemented such that an RFID antenna unit may be integrated into the flat components in a shape optimal for transmission and reception, and for function.

In this manner, the installation of laterally-positioned, high-volume antenna units requiring large installation space is avoided.

Furthermore, based on the invention, it may be provided that the flat components of the blocking arms in their blocking position are tilted with respect to the vertical toward the persons whose access authorization is to be read such that the electromagnetic or magnetic field of the antenna unit is essentially directed toward an area corresponding to the normal occupied area of the no-contact readable access authorization of the persons located directly in front of the turnstile.

This allows, on the one hand, targeted concentration of the electromagnetic or magnetic field toward the person located directly in front of the turnstile; and on the other hand, for the case in which the electromagnetic field is not shielded in the opposite direction, or that a magnetic RFID antenna unit is employed whose magnetic field extends in both directions perpendicular to the surfaces, it ensures that the electromagnetic or magnetic field of the antenna unit no longer receives the access authorization of a previous person since, because of the inclination angle of the flat components, the electromagnetic or magnetic field is essentially directed toward areas at the approximate height of the legs, ideally of the lower legs, of the previous person.

Thus, signal cross-talk interference with other persons is avoided. Also, the deletion of the installation of laterally-mounted antennas allows prevention of signal cross-talk to persons in adjacent passage points and/or access-monitoring devices.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
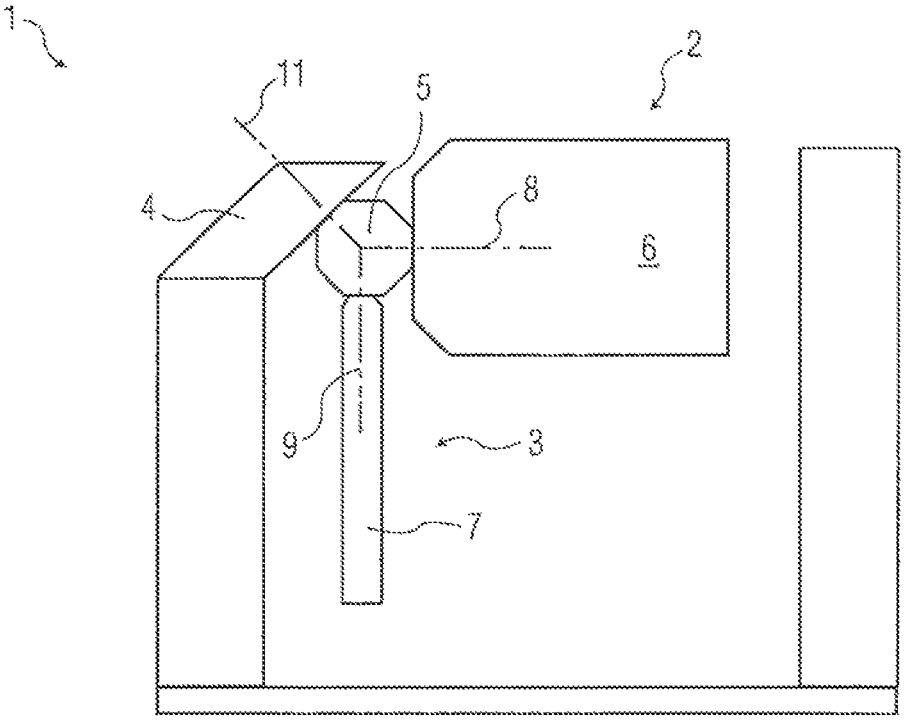
FIG. 1 is a side view of a personnel access-control device based on the invention comprising two blocking arms, wherein one blocking arm is in the blocking position and one blocking arm is in the free position.

The preferred embodiments of the present invention will now be described with reference to FIGS. 1-6 of the drawings. Identical elements in the various figures are designated with the same reference numerals.

Figure 2:
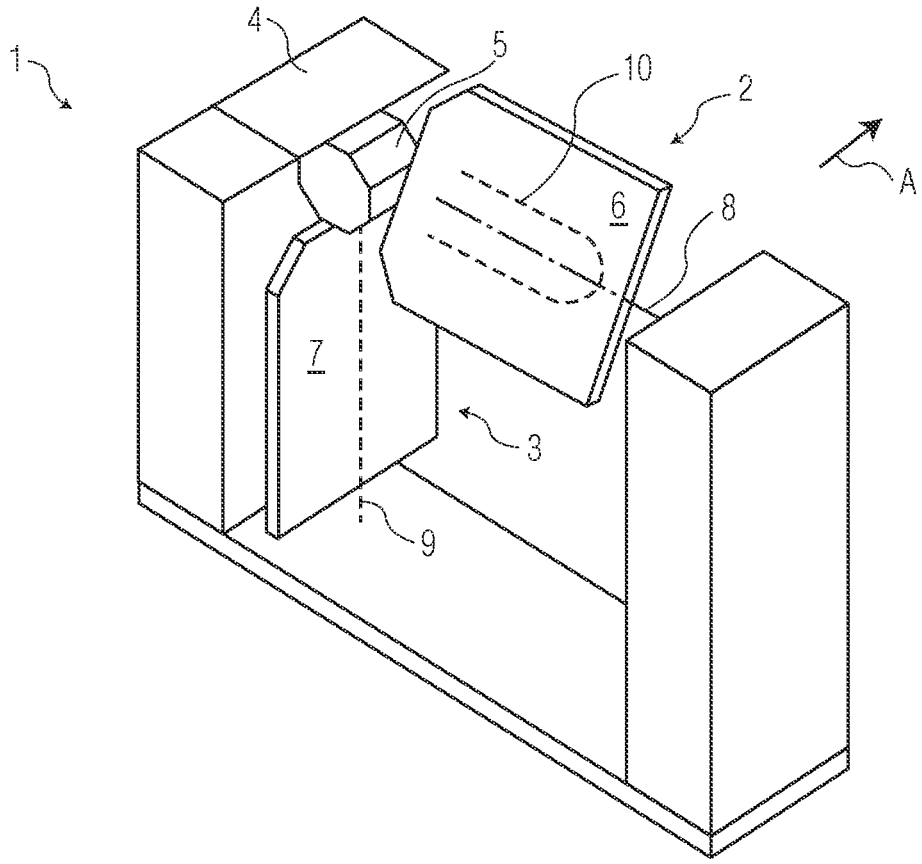
FIG. 2 is a perspective view of the personnel access-control device shown in FIG. 1.
Figure 3:
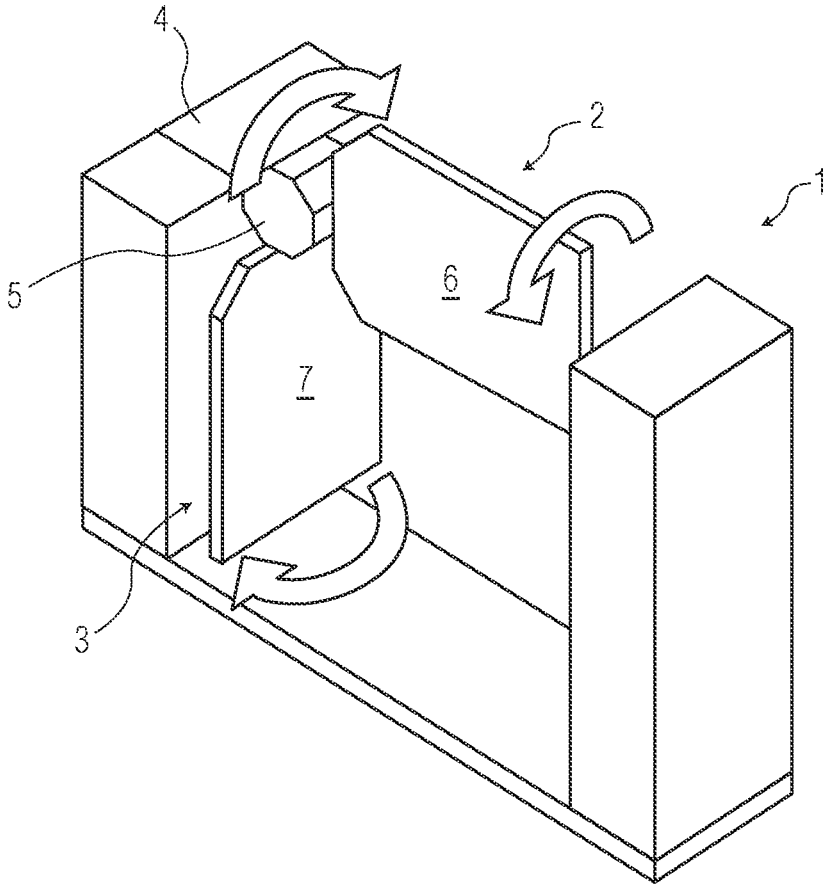
FIG. 3 is a perspective view of the embodiment of the personnel access-control device shown in FIG. 2 with arrows to reveal the possibility of rotation of the flat components with respect to the rotation of the main shaft.
Figure 4:
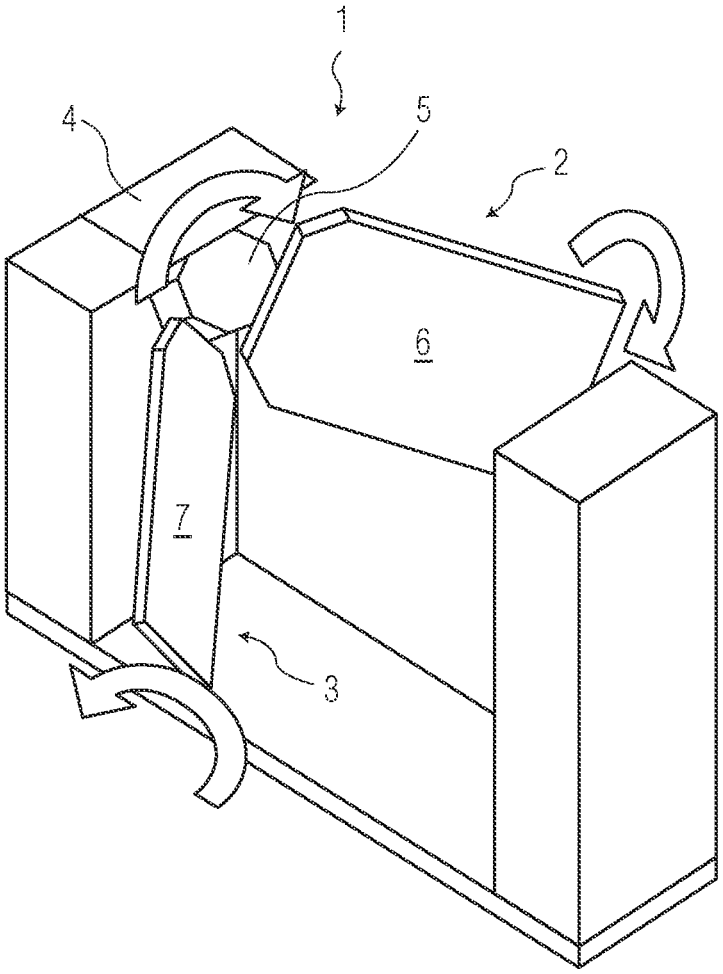
FIG. 4 is a perspective view of the invention embodiment shown in FIG. 3, whereby the rotational motion of the main shaft and of the flat components are shown at a later point in time.

FIGS. 1 and 2 show a an access control device or turnstile 1 constructed according to the invention. It includes two blocking arms 2, 3 connected with a main drive element 5 mounted on a carrier 4 for rotation about a main axis or shaft 11 which is angled, as shown, with respect to the vertical. The blocking arms 2, 3 may each assume a blocking position and a free position depending on the rotary movement about the main axis 11 and of the drive element 5. In the embodiment shown in FIG. 1, the first blocking arm 2 is in the blocking position while the second blocking arm 3 is in the free position. For the case in which three blocking arms are provided, they are usually positioned at an angular separation of 120° from one another (measured by projecting the arms onto a plane perpendicular to the rotating axis), so that each blocking arm may assume one blocking position and two free positions.

The rotational axis 11 of the drive element 5 is inclined with respect to the horizontal by 30° to 60°, advantageously 45°; the angle of the blocking arms 2, 3 to the rotational axis of the main shaft 5 may be 30° to 60°, advantageously 45°.

Based on the invention, the blocking arms 2, 3 possess flat components 6, 7, respectively, that are mounted so that they may be rotated about the longitudinal axes 8, 9 of the blocking arms 2, 3 which are angled with respect to the main axis 11. The rotation of the flat components 6, 7 of the blocking arms 2, 3 about the longitudinal axes 8, 9 occurs in dependence upon the rotation of about the main axis 11 such that, in the blocking position of the blocking arms, a pre-defined angular position of the flat components with respect to the vertical may be achieved and, in at least one free position, the flat component is rotated such that passage of a person is allowed and/or the passage width is not limited.

As FIGS. 1 and 2 show, the flat component 7 of the second blocking arm 3 in the free position is rotated about the longitudinal axis 9 such that essentially the entire passage width is available, so that, for example, during summer operation of a ski lift, a maximum passage width is established for child strollers, wheelchairs, or mountain bikes. In such applications, only one blocking arm is used as a rule. With reference to FIG. 2, in the blocking position of the blocking arms 2, 3, a pre-defined angular position of the flat components with respect to the vertical may be achieved. In the embodiment shown in FIG. 2, the flat components 6, 7 in the blocking position are inclined to the vertical at a pre-defined angle, as is visible based on the angular position of the flat component 6 of the first blocking arm 2.

Figure 1A:
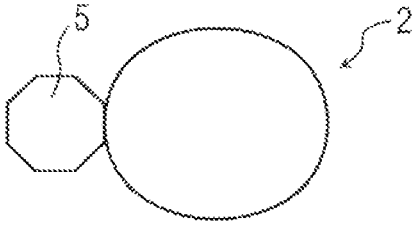
FIG. 1A shows an alternative embodiment for the blocking arms of the access-control device of FIG. 1.

The flat components 6, 7 of the blocking arms 2, 3 which are implemented with a rectangular shape in the embodiment shown in FIGS. 1 and 2, can, alternatively, be implemented in an elliptical shape (FIG. 1A) or in some other shape; for example, in a configuration designed to represent a sports activity. The flat components may be rigidly secured to the blocking arms 2, 3 for rotation therewith about their respective longitudinal axes 8, 9. Alternatively to this implementation, the flat components 6, 7 of the blocking arms 2, 3 may be mounted on a hollow shaft through which each of the blocking arms 2, 3 is mounted. In this case, the hollow shafts may be rotated about their respective axes 8, 9.

The rotary motion of the flat components 6, 7 about the longitudinal axes 8, 9 of the blocking arms 2, 3 may be provided electro-mechanically via common or individual electric motors assigned to each blocking arm and/or hollow shafts onto which the flat components 6, 7 are mounted. Alternatively, the rotary motion of the flat components 6, 7 of the blocking arms 2, 3 about the longitudinal axes 8, 9 of the blocking arms 2, 3 may be mechanically controlled by means of connecting-link guides for the blocking arms and/or for the hollow shafts onto which the flat components are mounted, or by means of a transmission functionally connected to the main shaft 11.

In an advantageous embodiment of the invention, the angular velocity of the rotary motion of the flat components 6, 7 about the longitudinal axes 8, 9 of the blocking arms 2, 3 is half of the angular velocity of the rotary motion about the main shaft or axis 11.

Figure 5:
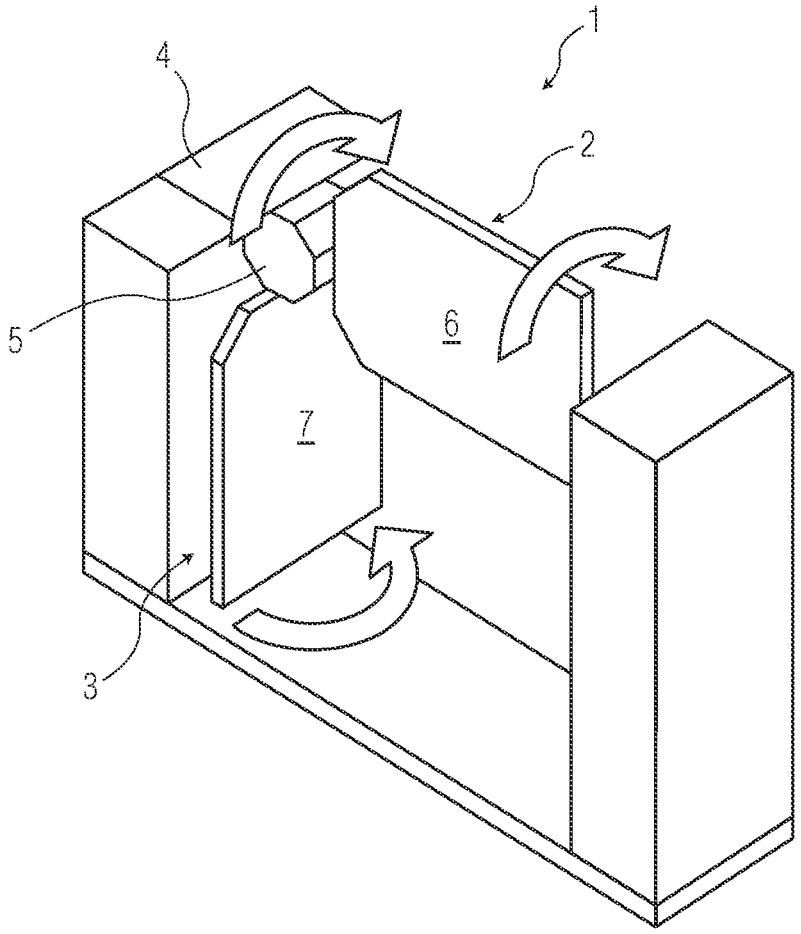
FIG. 5 is a perspective view of the invention embodiment shown in FIG. 2 to reveal an additional possibility of rotation of the flat components with respect to the rotation of the main shaft.
Figure 6:
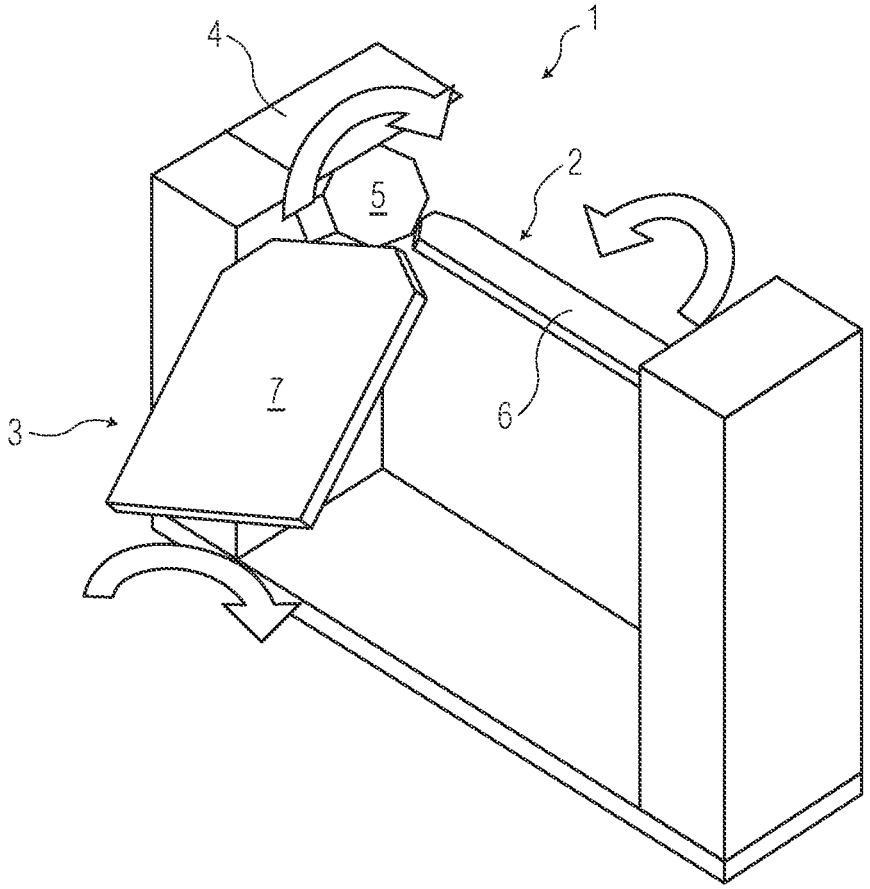
FIG. 6 is a perspective view of the invention embodiment shown in FIG. 5, whereby the rotational motions of the main shaft and of the flat components are shown at a later point in time.

The rotary motion of the flat components 6, 7 about the longitudinal axes of the blocking arms 2, 3 may be with or opposite the direction of rotation of the main shaft 5. In the embodiment shown in FIGS. 3 and 4, the rotary motion of the flat components 6, 7 about the longitudinal axes of the blocking arms 2, 3 are against the direction of the main shaft 5, whereby the embodiment shown in FIGS. 5 and 6, the rotary motion of the flat components 6, 7 about the longitudinal axes of the blocking arms 2, 3 is opposite to the direction of the main shaft 5. FIGS. 2 and 5 each show the point in time immediately after provision of access (the first blocking arm is still in the blocking position, and the second blocking arm 3 is in the free position), whereby FIGS. 4 and 6 each show a later point in time.

It may be provided that the rotary motion of the flat components 6, 7 about the longitudinal axes 8, 9 of the blocking arms 2, 3 based on the invention is not linear with respect to the rotary motion about the main shaft 11 and drive element 5. For example, the rotary motion may occur immediately after leaving the blocking position at a lower angular velocity, whereby after rotation about the main shaft 11 by a specified amount, e.g., by 30°, the angular velocity of the rotary motion of the flat components 6, 7 about the longitudinal axes 8, 9 of the respective blocking arms 2, 3 is increased. Thus, it may be prevented that passing persons come into contact with the flat components 6, 7 because of the rotation of the flat components 6, 7, or that the blocking arm in its free position touches the carrier 4.

In a particularly advantageous embodiment of the invention, it is proposed to integrate at least one RFID antenna unit into the flat components 6, 7 of the blocking arms 2, 3 that communicates with RFID transponders as data medium to read an access authorization, whereby the control of at least one antenna unit may be integrated into the flat components 6, 7. Such an antenna unit is shown in FIG. 2 with dashed lines, and is identified by index symbol 10.

With this, particularly when the angular velocity of the rotary motion of the flat components 6, 7 of the blocking arms 2, 3 about the longitudinal axes 8, 9 of the blocking arms 2, 3 is half that of the angular velocity of the rotary motion of the drive element 5 about the main axis 11, the rotary motion of the flat components 6, 7 about the respective longitudinal axes of the blocking arms 2, 3 may occur within the first half-rotation of the drive element 5 in the same or opposite rotational direction of the drive element 5, and during the second half-rotation of the drive element 5, in the opposite or same direction of the drive element 5 so that, upon one full rotation of the drive element 5, the flat components 6, 7 come to rest in their blocking position only with one rotational orientation. In this way the electromagnetic field of at least one antenna unit 10 is always directed toward the area in which a person whose access authorization is to be read is located. This also allows the configuration in which the antenna unit 10 emits merely in the direction perpendicular to the surface of the flat components, advantageously resulting in the fact that read-out of the access authorization of persons who have already passed through is prevented.

This configuration is also particularly advantageous if the flat components 6, 7 of the blocking arms 2, 3 are provided on one side with a conventional or electronic advertising surface in addition to, or as an alternative to, the minimum of one antenna unit 10 since that makes the advertising surface visible to the approaching person. In other embodiments, the flat components 6, 7 of the blocking arms 2, 3 may be provided on both sides with a conventional or electronic advertising surface with a display.

Based on the invention, in addition to, or as an alternative to, the configuration including at least one antenna unit 10 and/or an advertising surface, the flat components 6, 7 of the blocking arms 2, 3 may be illuminated on one or both sides, or a display device may be provided to display digits and/or text-symbol combinations, or symbols. For this, individual LED's, or in the case of a display device, at least one LED circuit board including a large number of individually-controllable RGB-LED's may be integrated whereby the surfaces of the flat components 6, 7 of the blocking arms 2, 3 that may be illuminated and/or that includes a display device are made at least partially of a translucent material such as a plastic polymer, particularly at those locations corresponding to the installed position of at least one LED circuit board and/or individual LED's. The display device may advantageously be configured as a traffic-lane signal. As explained above, since the flat components 6, 7 come to rest in the blocking position with only one rotational orientation, these embodiments ensure that the display device is always on the side facing the approaching person.

For the case in which the flat components 6, 7 include a display device to display digits and/or text-symbol combinations, or symbols, it may also be provided that the surface of the flat components is coated with a full opaque coating on the side facing away from or toward the minimum of one LED circuit board that is removed at locations corresponding to the installed position of the LED's of the at least one LED circuit board, making the display device translucent at these locations.

Control of the individual LED's or of the display device may also be integrated into the blocking arms 2, 3. Furthermore, the control circuit for the electronic advertising surface (if present) may also be integrated.

Furthermore, sensors may also be integrated into the flat components 6, 7 of the blocking arms 2, 3 that detect the presence of a person directly in front of the turnstile and activate the actuator for the turnstile, the electronics to control the antenna unit 10, and display device and/or electronic advertising surface because of the sensor signal.

In reference to FIG. 2, the flat components of the blocking arms in their blocking position are inclined from the vertical toward the persons whose access authorization is to be read such that the electromagnetic or magnetic field of the antenna unit 10 is directed essentially toward an area corresponding to the normal position of person located in front of the turnstile for contact-free access authorization, preferably toward an area between knee and shoulder. In FIG. 2, the passage direction is shown by arrow A.

This enables targeted concentration of the electromagnetic field toward the person located directly in front of the turnstile. Additionally, in the case where the electromagnetic field is not screened in the rearward direction, it ensures that the electromagnetic field of the antenna unit 10 no longer receives the access authorization from a previous a person whom the turnstile has already admitted, since the inclination angle of the flat components aims the electromagnetic field essentially toward areas basically corresponding to the height of the lower leg areas of the previous person. The inclination angle may advantageously possess a value between 0° and 45°.

In another embodiment of the invention, additional sensors may be provided by means of which aiming of the flat components of the blocking arms toward the approaching person may be based on distance and body size or other optional characteristics is possible. For example, sensors may be used that can identify the distance and body size of the approaching person, whereby based on this data, the inclination angle of the flat components in their blocking position are controlled such that the electromagnetic field of the antenna unit essentially corresponds to the normal area of the approaching person for contact-free access authorization, namely between knee and shoulder.

There has thus been shown and described a novel personnel access-control device in the form of a turnstile which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A personnel access-control device having a stationary carrier and a rotatable gate with at least two linear blocking arms each having only a single longitudinal axis, said gate being mounted for rotary movement with respect to the carrier about a main axis that is angled with respect to a vertical, said main axis being at an acute angle with respect to said axis of each of said blocking arms, wherein the at least two blocking arms are rotatable about said main axis between a blocking position in which at least one of the blocking arms blocks passage of a person through the device and at least one free position in which the at least one of the blocking arms allows the passage of said person through the device, wherein flat components are mounted to said blocking arms for rotary movement about said main axis and the longitudinal axes of the associated blocking arms, said rotary movement of said flat components about said longitudinal axes of the blocking arms being coupled with the rotary movement of the gate about the main axis such that as the gate rotates about the main axis, the blocking arms and the flat components are rotated about the axes of the blocking arms by at least one motor, whereby when the at least one of the blocking arms is in the blocking position the flat component thereof is at a first defined angle with respect to the vertical to present a barrier to the passage of the person through the device and when the at least one of the blocking arms is in the free position the flat component thereof is at a second defined angle with respect to the vertical to allow the passage of the person through the device.

2. The personnel access-control device the according to claim 1, wherein the flat component has a shape selected from the group consisting of rectangular and elliptical.

3. The personnel access-control device in accordance with claim 1, wherein an angular velocity of the rotary movement of said blocking arms and said flat components about said longitudinal axes is half an angular velocity of the rotary movement of the gate about the main axis.

4. The personnel access-control device in accordance with claim 1, wherein the rotary movement of said blocking arms and the flat components about said longitudinal axes is in the same direction as the rotary movement of the gate about the main axis.

5. The personnel access-control device in accordance with claim 1, wherein the rotary movement of said blocking arms and the flat components about said longitudinal axes is in an opposite direction to the rotary movement of the gate about the main axis.

6. The personnel access-control device in accordance with claim 1, wherein the rotary movement of said blocking arms and the flat components about said longitudinal axes is non-linear with respect to the rotary movement of the gate about the main axis.

7. The personnel access-control device in accordance with claim 6, wherein the rotary movement of said blocking arms and the flat components about said longitudinal axes during a first half of the rotary movement of the gate about the main axis occurs in one of a same or opposite direction, to said rotary movement of the gate about the main axis, and during a second half of the rotary movement of the gate about the main axis, the rotary movement of said blocking arms and the flat components about said longitudinal axes occurs in the other of the same or the opposite direction to said rotary movement of the gate about the main axis.

* * * * *